US011130166B2

(12) United States Patent
Flanagan et al.

(10) Patent No.: US 11,130,166 B2
(45) Date of Patent: Sep. 28, 2021

(54) CYLINDRICAL TOOL MATCHING SYSTEM

(71) Applicant: Reed Machinery, Inc., Worcester, MA (US)

(72) Inventors: James D. Flanagan, Milford, MA (US); Steven B. Copeland, Oakham, MA (US); Adam M. Kettles, Lancaster, MA (US); Brian R. Faucher, Paxton, MA (US); Patrick G. White, Spencer, MA (US); Cody F. Morse, Shirley, MA (US); Kenneth F. Arsenault, Charlton City, MA (US)

(73) Assignee: Reed Machinery, Inc., Worcester, MA (US)

( * ) Notice: Subject to any disclaimer, the term of this patent is extended or adjusted under 35 U.S.C. 154(b) by 689 days.

(21) Appl. No.: 15/754,483

(22) PCT Filed: Oct. 6, 2017

(86) PCT No.: PCT/US2017/055516

§ 371 (c)(1),
(2) Date: Feb. 22, 2018

(87) PCT Pub. No.: WO2018/067916

PCT Pub. Date: Apr. 12, 2018

(65) Prior Publication Data

US 2020/0230689 A1 Jul. 23, 2020

Related U.S. Application Data

(60) Provisional application No. 62/405,496, filed on Oct. 7, 2016.

(51) Int. Cl.
*B21H 3/04* (2006.01)
*B21K 1/56* (2006.01)

(52) U.S. Cl.
CPC ..... *B21H 3/04* (2013.01); *B21K 1/56* (2013.01)

(58) Field of Classification Search
CPC ... B21H 3/02; B21H 3/04; B21H 1/00; B21H 1/18; B21H 3/00; B23G 7/00; B23G 7/02;
(Continued)

(56) References Cited

U.S. PATENT DOCUMENTS 4,615,197 A 10/1986 Allebach et al.
5,379,620 A 1/1995 Greis
(Continued)

FOREIGN PATENT DOCUMENTS

DE 0296594 A2 * 12/1988 ..... B21H 3/06
EP 0296594 A2 * 12/1988 ..... B21H 3/04
(Continued)

OTHER PUBLICATIONS

EPO296594A2 English Translation, EPO, 1988.*
(Continued)

*Primary Examiner* — Shelley M Self
*Assistant Examiner* — Claudia V Caldera
(74) *Attorney, Agent, or Firm* — Alix, Yale & Ristas, LLP

(57) ABSTRACT

A die matching system which is preferably implemented in die rolling machinery for fasteners employs witness or reference marks on each of the dies. An eddy current sensor is employed to sense the witness marks and to detect change in the relative position of the witness mark and hence the position of the rotatable dies. The change in position is then processed and a signal is transmitted to servo motors to change the relative position of the dies to compensate for the position changes continuously during the operation of the die rolling machinery. In one preferred form, the witness
(Continued)

mark is in the form of a recess milled into the bottom end surface of the cylindrical die.

21 Claims, 7 Drawing Sheets

(58) Field of Classification Search
CPC ..... B23G 2240/52; B21K 1/56; G05B 2219/45215
USPC ..... 470/44, 45
See application file for complete search history.

(56) References Cited

U.S. PATENT DOCUMENTS 5,560,238 A * 10/1996 Allebach et al. ..... B21H 3/06 72/13.4
5,697,277 A 12/1997 Okonski et al.
5,829,115 A * 11/1998 Speller, Jr. et al. ..... B23Q 5/40 72/454
6,947,800 B2 * 9/2005 Flanagan et al. ..... B21C 51/00 72/20.1
2003/0014150 A1 1/2003 Flanagan et al.
2015/0037447 A1 * 2/2015 Rechter et al. ..... B29C 48/256 425/135
2015/0233736 A1 * 8/2015 Habenschaden ..... F16H 63/30 324/207.15

FOREIGN PATENT DOCUMENTS

JP 3581259 B2 * 10/2004 ..... B21H 3/02
JP 2009214153 A * 9/2009
JP 2010064101 A * 3/2010

OTHER PUBLICATIONS

JP2010064101, Machine Translation, 2008.*
JP2009214153, Machine Translation, 2009.*
JP 3581259 Machine Translation, 2004 (Year: 2004).*
EP 0296594 Machine Translation, 1988 (Year: 1988).*
Search Report and Written Opinion.
International Preliminary Report on Patentability.

* cited by examiner

CYLINDRICAL TOOL MATCHING SYSTEM

BACKGROUND

This disclosure relates generally to apparatus and methods for cold forming workpieces on thread and form rolling machines, including combination machines that make bolts and threaded fasteners. More particularly, this disclosure relates to apparatus and methods for machines which employ cylindrical thread dies.

In thread and form rolling machinery for which the present disclosure has particular application, workpieces are serially transformed in shape by a rolling process as the workpieces pass between a set of two or three dies. Thread and form rolling machinery are primarily of the following types: flat die machines, two die cylindrical machines, three die cylindrical machines, planetary machines and rack rolling machines. Regardless of the type of machine, the dies employed have work surfaces generally configured in reverse shape to the ultimate form to be produced. Hardened work surfaces of the dies are pressed against the periphery of a plain cylindrical blank and ultimately reconfigure the surface of the workpiece as it rolls on the faces of the dies.

In order to produce a suitable product, the dies require precise manufacturing and positioning. As the workpiece blank rolls from one die to the next, the form of the subsequent die requires engagement at the proper position to provide a finished continuity of the intended form which is typically a continuous thread surface.

The proper positioning of the dies relative to each other is dependent upon a number of variables related to the form, the dies and the workpiece blank diameter. In order to produce acceptable finished products and to minimize damage to the dies, the die positioning which is commonly referred to as "die matching" requires a precision positioning. The proper positioning is accomplished by manual machine and/or tool adjustments by a skilled operator. In a typical conventional die matching method, a sample part is typically placed between the dies with just enough pressure to mark the blank workpiece. The machinery is then advanced slightly to partially roll the part. The part is removed from the machine and visually examined by the operator to determine if the produced form of the dies is within the specification. Multiple die and/or machine adjustments are made and the adjustment process is replicated until the finished part that meets specification is produced. Once the latter is accomplished, the machinery is then operated and the normal die penetration of the blank is accomplished as the workpieces are rolled to produce the finished products.

It will be appreciated that the conventional die matching process is a time consuming, trial and error process which requires a highly experienced skillful machine operator and a significant amount of time for properly matching the dies. Consequently, the typical die matching process is not efficient and diminishes productivity. Another significant issue is that skilled operators are not always readily available.

There have been a number of proposals to address and improve the die matching process. In the flat die thread rolling machine context, pressure sensors are located at positions such that when a thread is being cold formed, a mismatch of the dies will produce increased pressure in a particular direction as the misaligned form on the blank part moves to the next die. A pressure sensor automatically sends a signal to a computer for adjustment of the process. This latter improvement typically does not apply to cylindrical and planetary machines which present different geometrical constraints.

SUMMARY

Briefly stated, a machine tool system includes tools for serially cold forming workpieces comprising a first rotatable tool having a first die which engages a workpiece. A second rotatable tool has a second die which engages the workpiece and has a reference feature. A sensor senses the position of the reference feature and generates a matching signal. A processor receives the matching signal and generates a positioning signal. A positioner receives the positioning signal and adjusts the relative position of the first and second dies to match the dies.

The first and second dies are cylindrical dies. Each of the dies preferably defines a helical thread form and the reference feature comprises a mark disposed at a pre-established distance from the start of the helical thread form. The positioner comprises a servo motor and mechanical linkage which adjusts the position of one of the dies. The first and second tools, in one embodiment, engage a workpiece to produce a finished fastener. In one embodiment, a third tool comprises a cylindrical die which also has a reference feature.

The sensor is preferably an eddy current sensor. The sensor may also be an optical sensor, an electromagnetic sensor, an ultrasonic sensor or a mechanical sensor. The reference feature is preferably a recess defined in an end surface of the die.

A machine tool system includes tools operable for serially cold forming workpieces. A first rotatable tool comprises a first positioner and a first die which engages a workpiece and has a reference feature. A second rotatable tool comprises a second positioner and a second die which engages the workpiece and has a second reference feature. A first sensor senses the position of the first reference feature and generates a first matching signal. A second sensor senses the position of the second reference feature and generates a second matching signal. A processor receives the first and second matching signals, determines changes in the position of the dies and generates corresponding positioning signals to the first and second positioners which control the positions of the first and second dies to thereby match the dies.

The first and second dies are preferably cylindrical dies. Each of the cylindrical dies, in one application, defines a helical thread form and the reference feature comprises a recess defined in an end of the die and disposed at a pre-established distance from a match point of the thread form.

Each of the sensors is an eddy current sensor. Each positioner comprises a servo motor and a mechanical linkage which adjusts the position of one of the dies.

The machine tool system preferably also comprises a third tool comprising a cylindrical die with a third reference feature. The first, second and third tools rotatably engage a workpiece to produce a threaded fastener in one application.

A method for matching rotatable dies in a cold forming tooling machine comprises sensing a change of position in a reference feature on each of the dies while the machine is operating and employing the change in the position to adjust the position of the die to continuously match the dies while the machine is operating. A change in eddy current of each die is employed to sense the change in position of the die. The method also comprises angularly adjusting the position of the die by means of a servo motor. In one preferred method, each of the cylindrical dies has a recess defined in an end surface of the die and disposed in a pre-established position relative to a match point on the die.

DETAILED DESCRIPTION

Figure 1:
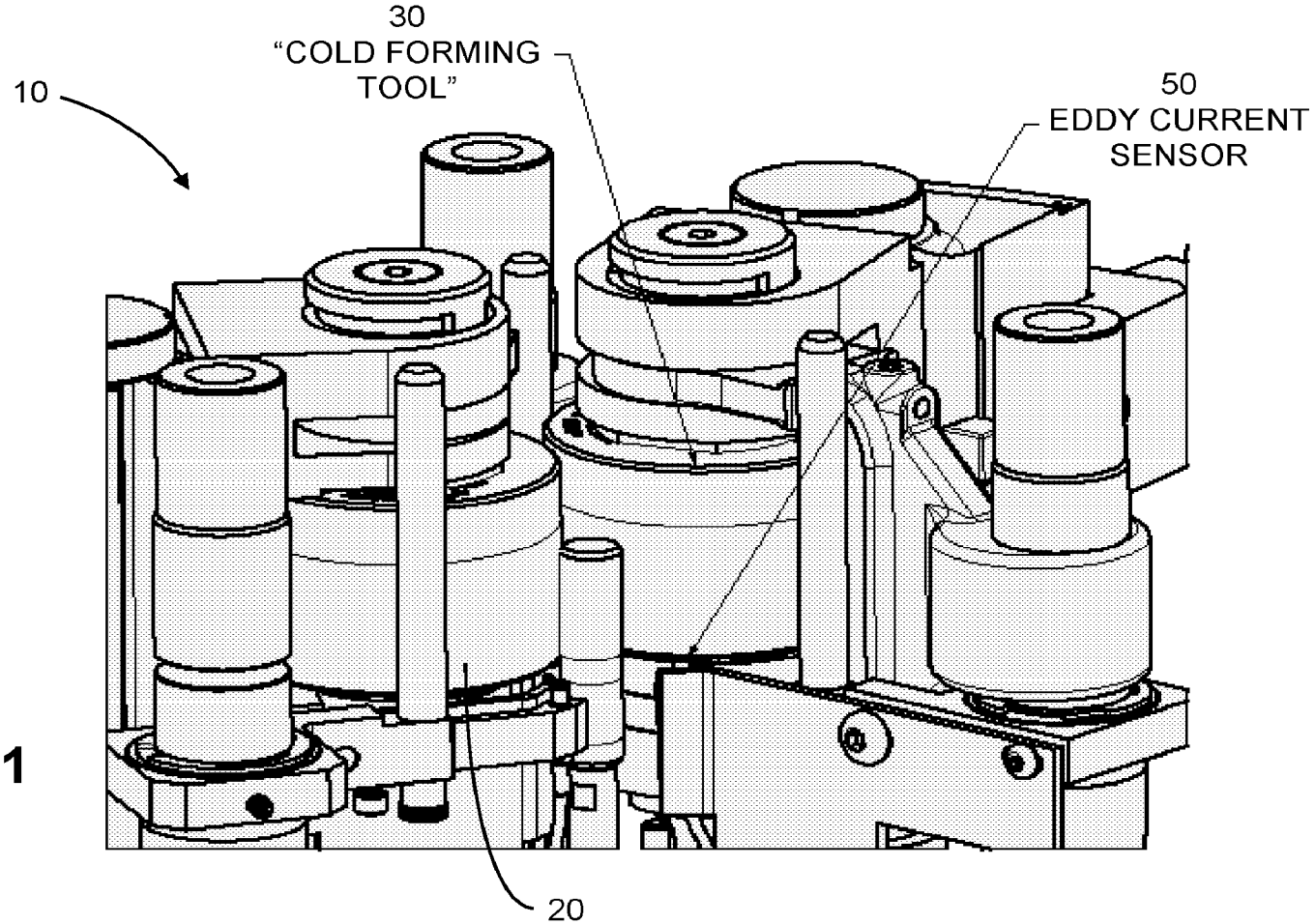
FIG. 1 is an annotated perspective view of machinery for implementing a tool matching system.
Figure 2:
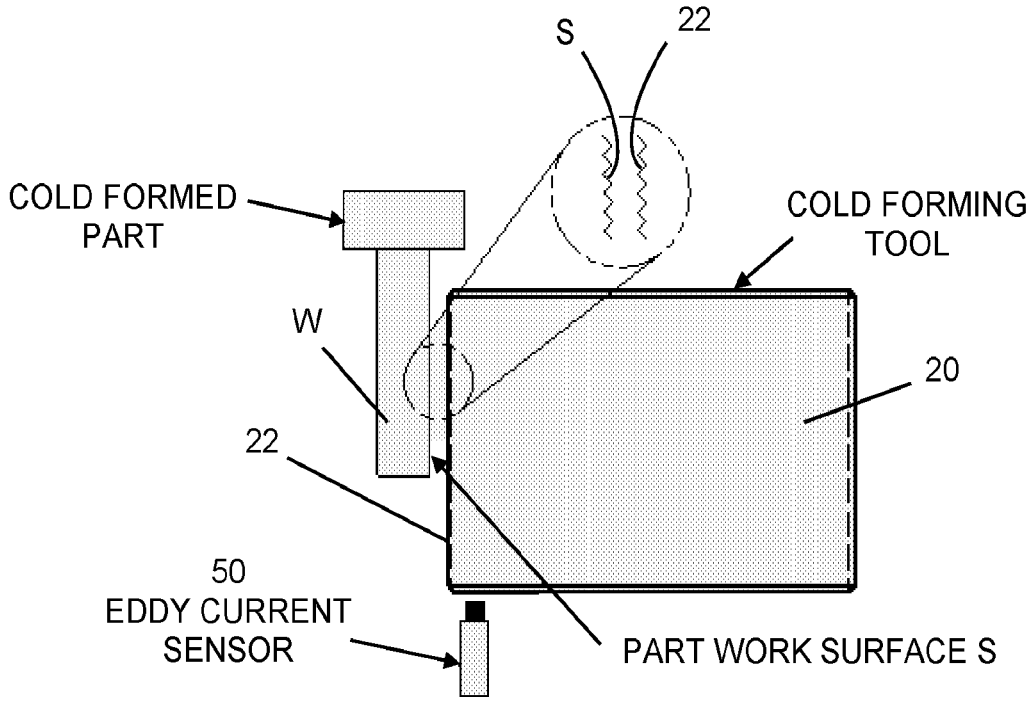
FIG. 2 is an annotated side schematic view illustrating a workpiece and a portion of the machinery for the tool matching system illustrated in FIG. 1.
Figure 3:
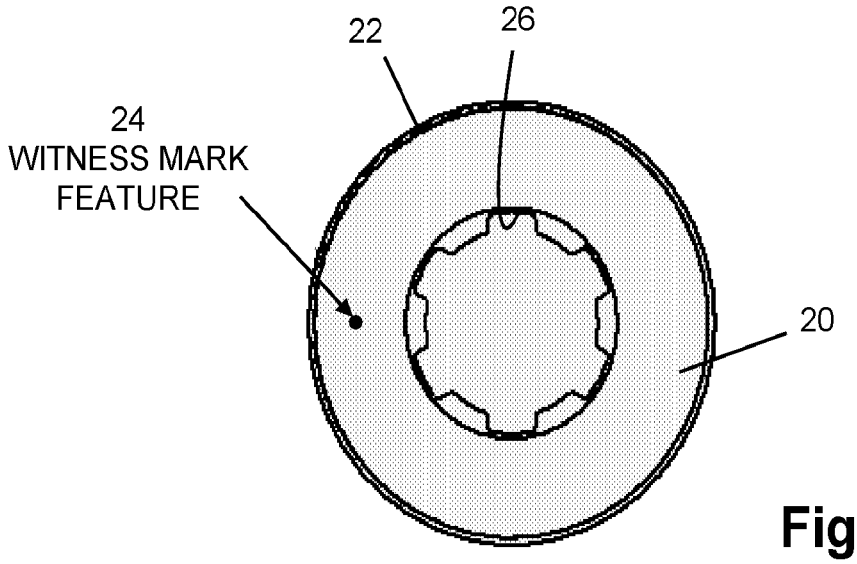
FIG. 3 is an annotated schematic bottom plan view of a tool for the machinery of FIG. 2.
Figure 4:
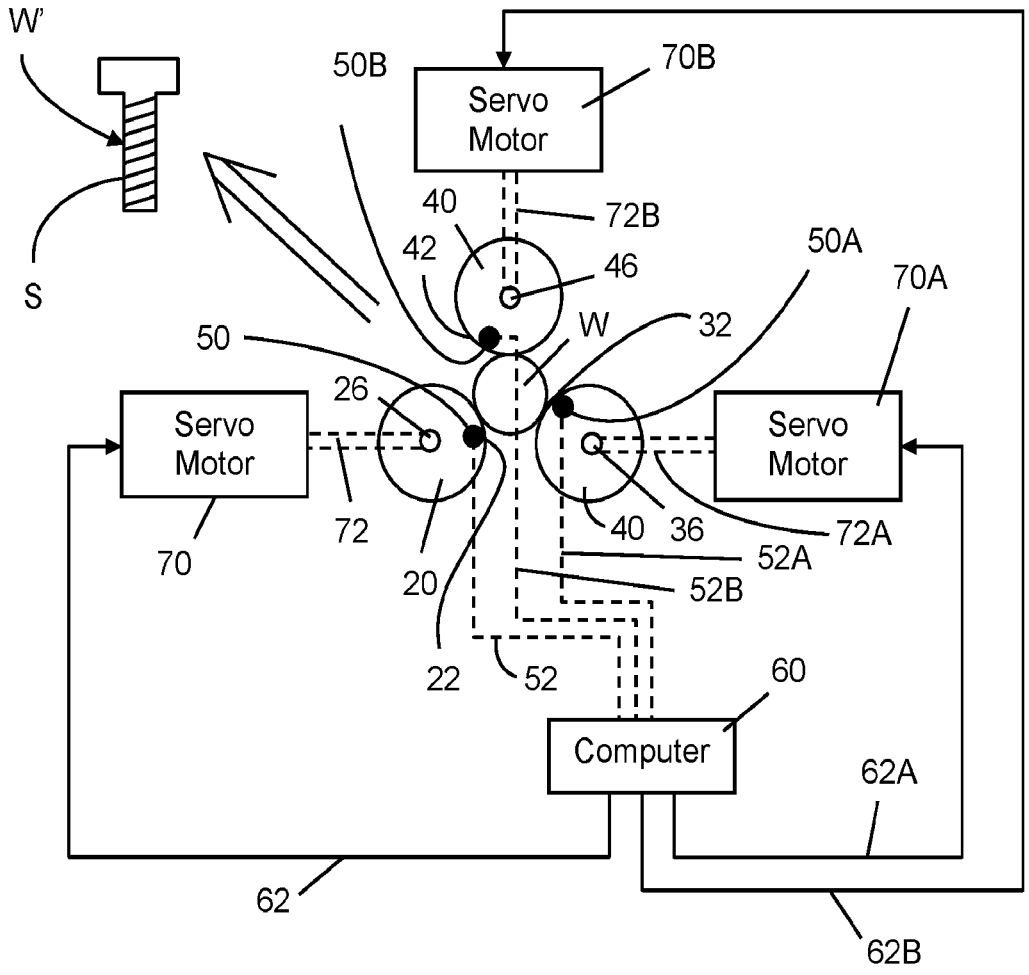
FIG. 4 is a schematic view further illustrating the tool matching system of FIG. 1.

With reference to the drawings wherein like numerals represent like parts throughout the figures, a machine for cold forming a workpiece which employs one or more tools in the form of cylindrical dies or segments is generally designated by the numeral 10. The machine 10 is preferably in the form of a cold rolling machine which employs two or more cylindrical dies 20, 30 and 40 which rotate about a workpiece W to form a finished workpiece W' preferably in the form of a threaded fastener. The tool matching system as described below functions to automatically match the dies throughout the uninterrupted operation of the machine so that substantially identical finished workpieces are serially manufactured, and the dies are continuously matched in an automatic manner as the finished workpieces are produced without requiring manual adjustment or matching upon the operator's demand.

Each die workpiece 22, 32, 42 has a form which is essentially the reverse of the finished surfaces of the workpiece. Each die workpiece typically has multiple angularly spaced match point positions. As each die rotates about the workpiece W and engages the workpiece, a reference edge of the die starts the form which, for the preferred application, is a helical thread. The dies are positioned in cooperative relationship so that the formed thread is substantially continuous about the workpiece.

One or more dies are provided at an underside or a top side location with a witness or reference mark 24. The reference mark has a pre-established relationship to a match point of the die. The reference mark is preferably not applied to the working face of the die. The reference mark 24 is preferably in the form of a recess, a notch or a small appendage. Alternatively, any discontinuous conductivity in the surface of the die which is detected by an eddy current could also be employed. For example, the surface of the die could be sprayed with dissimilar materials which exhibit different conductive properties. The reference mark essentially defines the position of the die and hence, for the preferred application, the angular height of the helical thread.

An eddy current sensor 50 is mounted in fixed position relative to the rotatable die to sense a position relative to the reference mark 24. The eddy current sensor generates a field in the conductive die which produces a distinctive eddy current in the die and produces an output signal 52 to a processor or computer 60. As the reference mark 24 moves due to a changed position of the die, the sensor 50 senses the changed eddy current. The eddy current signal for the sensor provides an input to a controller of the computer. The computer 60 calculates the change in the eddy current and hence the position changes of the reference mark 24 and the corresponding die 20.

Alternatively, other types of sensors, such as, for example, optical sensor such as lasers, cameras, infrared sensors may be employed. Alternatively, electromechanical, mechanical and ultrasonic sensor can be employed. Each sensor is employed to detect the change of position of the die via a feature applied to a die related to the start of the die form to control the position of the die or matching die.

The computer 60 then generates an output matching signal 62 to the positioner for the die 20. The positioner preferably includes a servo motor 70. The servo motor 70 operates a mechanical linkage 72 to change the positon of the spindle or spindles which define the position of the die 20. The servo motor output may be angular. The position may essentially be established by the position of the central shaft 26 for each die.

For some embodiments, an eddy current sensor 50A and a servo motor 70A are optionally provided for die 30. For some embodiments which employ three cylindrical dies, an eddy current sensor 50B and servo motor 70B are also optionally employed for die 40.

Figure 5:
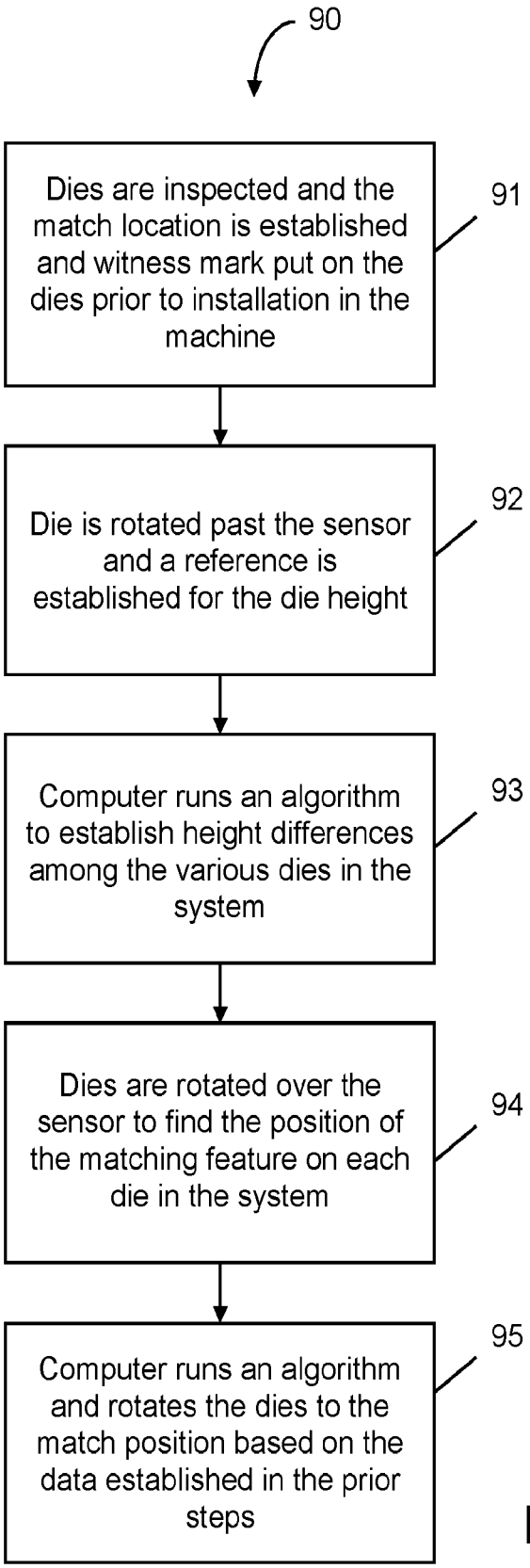
FIG. 5 is a block diagram illustrating the operation of the tool matching system.
Figure 6:
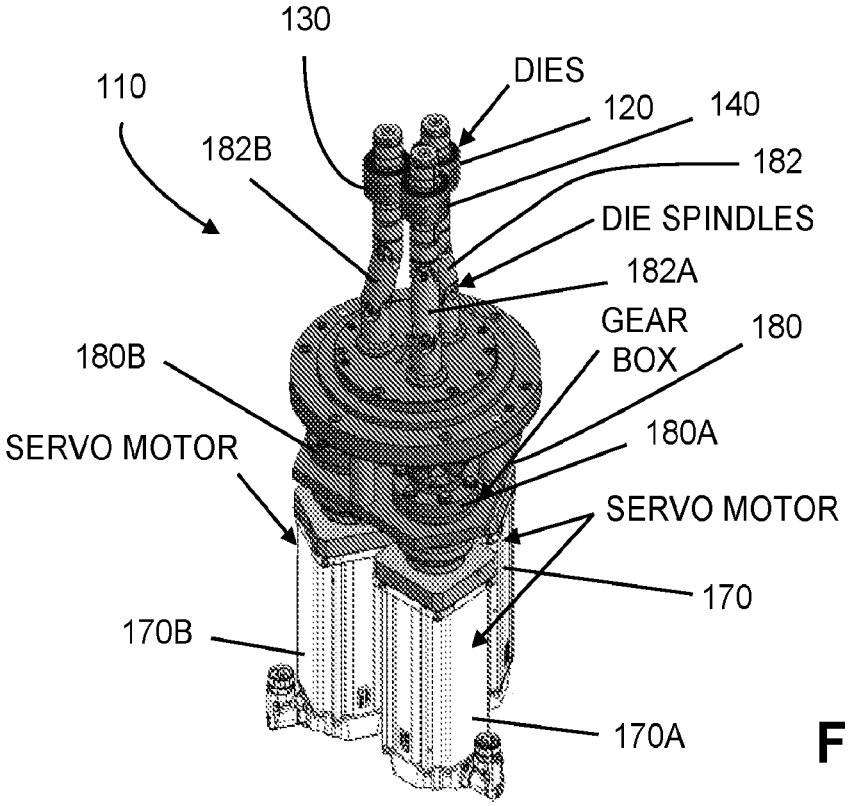
FIG. 6 is a fragmentary perspective view of machinery for implementing a tool matching system.
Figure 7:
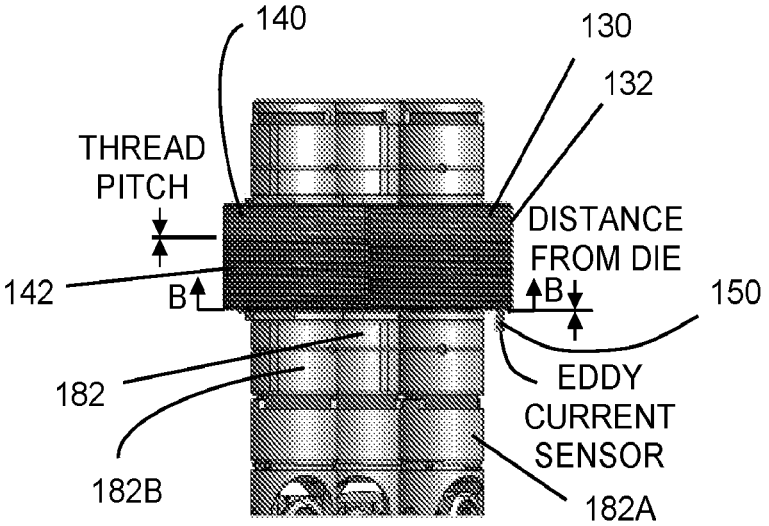
FIG. 7 is an enlarged annotated, fragmentary diagrammatic side view of the machinery of FIG. 6.
Figure 8:
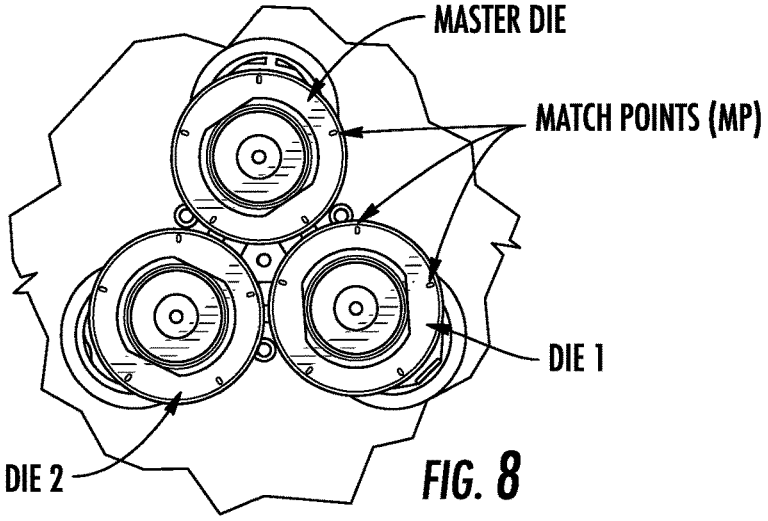
FIG. 8 is an annotated fragmentary top plan view further illustrating the dies and match points for the dies of the machinery of FIG. 6.

The die matching process is described in the block diagram 90 of FIG. 5 at composite step 91. The dies are initially inspected and the match location is established. Each witness mark is put on the dies prior to installation in the machine. For some embodiments employing two cylindrical dies 20 and 30, only one die has a mark 24, the position of which is sensed by the eddy current sensor 50.

The die is rotated past the sensor 50 and a reference is established for the die height at step 92. It should be appreciated that an angular adjustment changes the effective working die height.

A computer program runs an algorithm which establishes height differences among various dies in the system at step 93. The dies are rotated over the sensor to find the position of the matching feature for each die in the system at step 94.

After the reference positions are established, the computer runs an algorithm and rotates the dies to the match position based on the optimal position established in the prior steps at composite step 95. This process is repeated as the cold forming roll thread machine continuously operates and thus the dies 20 and 30 or 20, 30 and 40 are continuously matched throughout the operation of the machine without requiring a manual adjustment or matching upon the operator's demand.

Each eddy current sensor 50 may be of numerous forms and functions which emits an electromagnetic field to induce a field in the die/tool. The reference mark position is sensed by the changes in eddy current as the reference mark is effectively moved in and out of the field. It will be appreciated that the position of the beginning of the form or match position on the working faces of the dies thus is indirectly sensed by the eddy current sensor.

The dies 20, 30 and 40 essentially rotate on respective shafts 26, 36 and 46 and the relative positions between the two or three cylindrical dies is continuously adjusted. The reference mark feature indicates when the die is rotated to position over the sensor which is correlated with the information from the servo motor 70 that links with the spindle shaft of the die.

With reference to FIGS. 6-10, cold rolling machine 110 employs cylindrical dies 120, 130 and 140 which cooperatively rotate about a workpiece to form a threaded fastener. Each die working surface 122, 132, 142 has a form which is essentially the reverse of the finished surfaces of the workpiece. As each die rotates about the workpiece and engages the workpiece, a reference edge of the die starts the form which, for the preferred application, is a helical thread. The dies are positioned in cooperative relationship so that the form thread is substantially continuous about the workpiece.

It will be appreciated that one of the dies, such as, for example, die 120, is a master die. The cylindrical dies are configured so that they have angularly spaced match points 123, 133 and 143.

Figure 9:
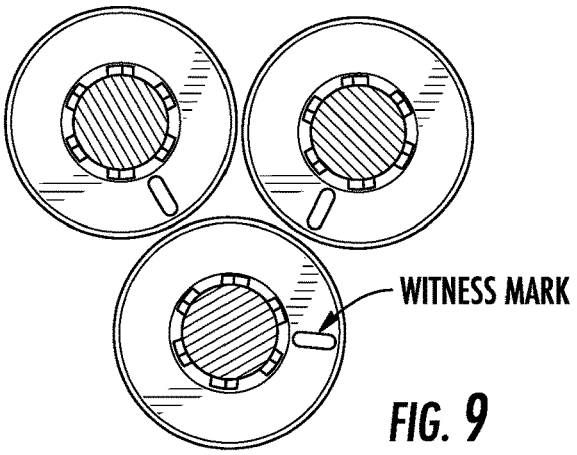
FIG. 9 is an annotated bottom sectional view taken along the line B-B of the machinery of FIG. 7.
Figure 10:
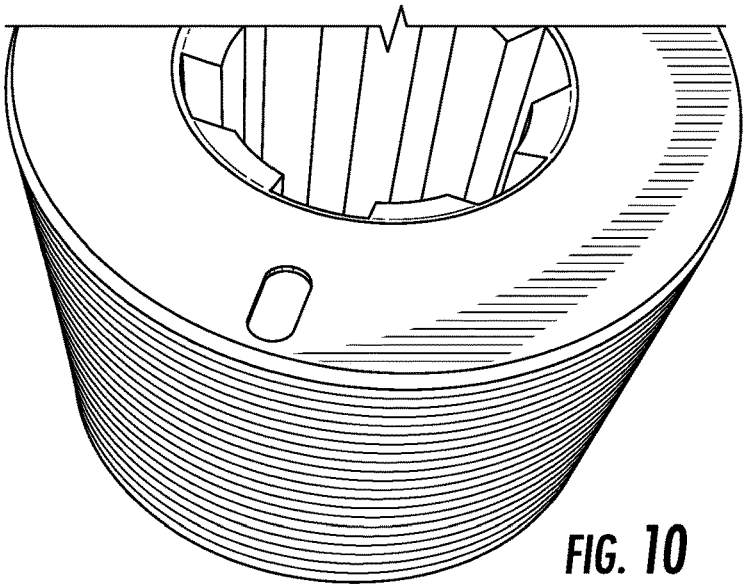
FIG. 10 is an enlarged fragmentary perspective end view of a die for the machinery of FIG. 6.

The bottom or underside face of the cylindrical dies 120, 130 and 140 is provided with a witness mark 124, 134 and 144, respectively. In a preferred form, each reference mark is substantially identical and is milled into the end surface of the die and is approximately 4 mm wide by 9 mm long by 0.55 mm deep, as best illustrated in FIGS. 9 and 10.

An eddy current sensor 150 is mounted in fixed position on a fixture relative to the rotatable die. In a preferred form, the eddy current sensor 150 has a range of 1 mm and is accurate and repeatable within 0.003 mm. A preferred sensor is a Micro Epsilon DT370-U1-AC3 sensor marketed by Micro Epsilon America of Raleigh, N.C. The eddy current controller outputs the voltage between 0 and 10 VDC which is calibrated to read a distance from the die.

The eddy current sensor 150 generates a field in the conductive die which produces a distinctive eddy current in the die and produces an output signal to a processor or a computer. As the reference mark moves due to a changed position of the die, the sensor senses the changed eddy current and provides an eddy current signal input to a controller of the computer. The computer calculates the change in the eddy current which is a function of the thread pitch, the number of match positions per die and the distance variation or change between the sensor and the die. The thread pitch and number of match positions per die are input into the computer or processor for a given project. An eddy current sensor is preferably provided for each die.

The computer generates an output matching signal to the positioner for each of the dies 120, 130, 140. The positioner includes a servo motor 170 170A, 170B which drives each die via a gear box 180, 180A, 180B and a die spindle 182, 182A, 182B. The servo motor output is angular which corresponding changes via the spindles, the relative angular positions of the die. Thus, the dies are continuously matched throughout the operation of the machinery.

Figure 11:
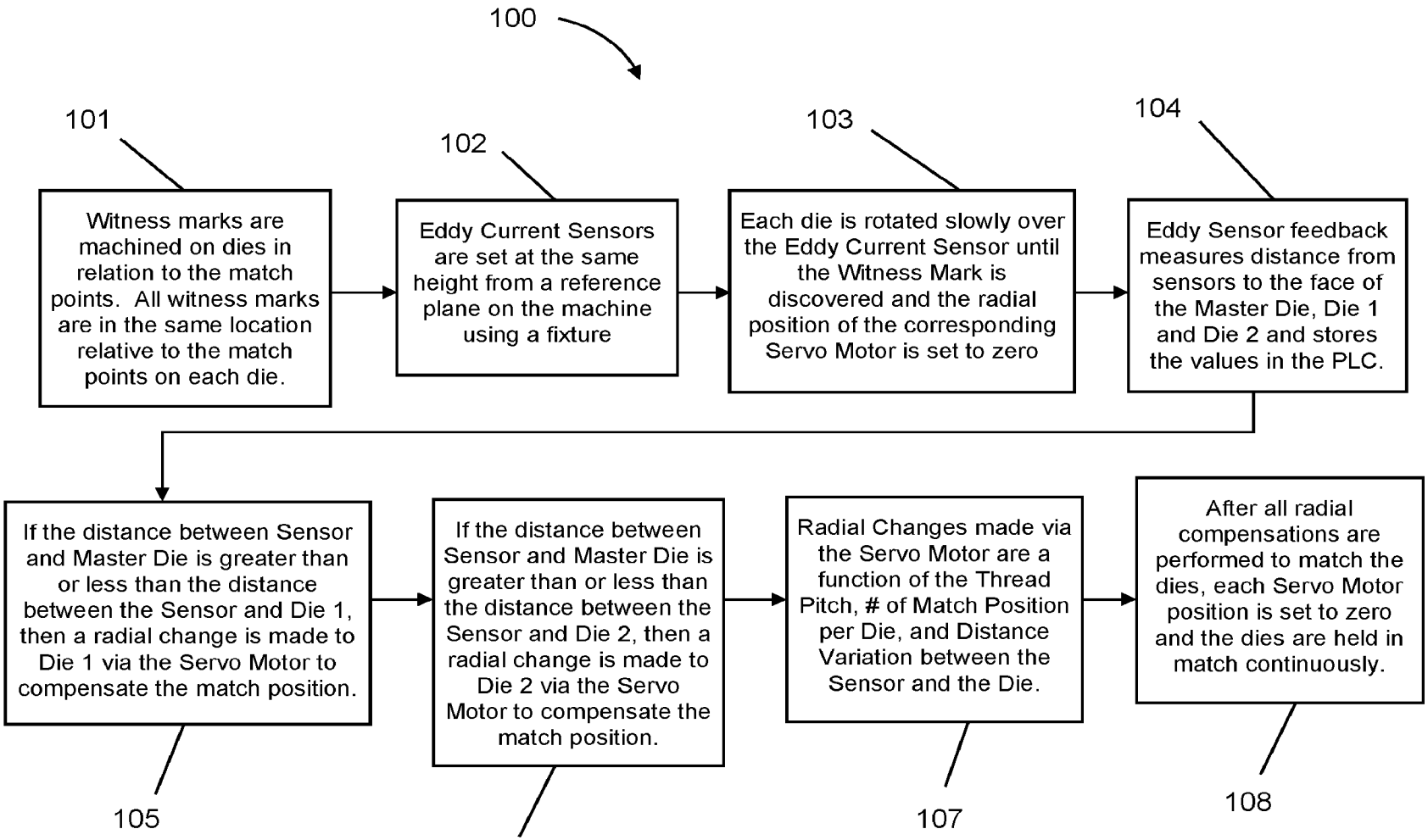
FIG. 11 is a block diagram of the die matching system implemented for the machinery of FIG. 6.

With reference to FIG. 11, the die matching system steps are generally summarized by algorithm 100. At step 101, the witness marks 124, 134, 144 are machined on dies 120, 130, 140 in pre-established relation to the match points 132, 133, 143. All witness marks are in the same location relative to the match points on each of the dies. Each eddy current sensor 150 is set at the same height from a reference plane on the machine using a fixture at step 102.

Each die is then rotated slowly over the corresponding eddy current sensor until the witness mark is discovered. The radial position of the corresponding servo motor 170, 170A, 170B is then set to 0 at step 103. At composite step 104, the eddy sensor feedback measures the distance from the sensors to the face of the master die (120), die 1 (130) and die 2 (140) and stores the values in the computer.

At step 105, if the distance between the sensor 150 and the master die 120 is greater than or less than the distance between the sensor and die 1 (130), then a radial change is made to die 1 via the servo motor 170A to compensate for the matched position. At step 106 if the distance between the sensor and the master die 120 is greater than or less than the distance between the sensor and die 2 (140), then a radial change is made to the die 2 via the servo motor 1706 to compensate for the die deviation from the matched position.

As noted at step 107, each radial change is made via the servo motor as a function of the thread pitch, the number of match positions per die and the distance variation between the sensor and the die.

As indicated at step 108, after all radial compensations are performed to match the dies, each servo motor position is set to 0 and the dies are effectively automatically held in a continuous match as the machine operates.

While preferred embodiments of the foregoing invention have been set forth for purposes of illustration, the foregoing description should not be deemed a limitation of the invention herein. Accordingly, various modifications, adaptations and alternatives may occur to one skilled in the art without departing from the spirit and the scope of the present invention.

The invention claimed is:

1. A machine tool system including tools for serially cold forming workpieces comprising:

a first rotatable tool having a first die which engages a workpiece and having a first reference indentation defined in an end surface of said first die at a pre-established position relative to a match point of said first die;

a second rotatable tool having a second die which engages said workpiece and having a reference indentation defined in an end surface of said second die at a pre-established position relative to a match point of said second die;

a first sensor which senses a position of said first reference indentation and generates a first matching signal;

a second sensor which senses a position of said second reference indentation and generates a second matching signal;

a processor which receives said first and second matching signals and generates a positioning signal in response to said first and second matching signals; and a positioner which receives said positioning signal and adjusts the relative position of said first and second dies to match said dies.

2. The machine tool system of claim 1 wherein said first and said second dies are cylindrical dies.

3. The machine tool system of claim 2 wherein said dies each define a helical thread form and said reference indentation is disposed at a pre-established distance from the start of the helical thread form.

4. The machine tool system of claim 1 wherein said positioner comprises a servo motor which adjusts the position of one of said first or second dies.

5. The machine tool system of claim 1 wherein said first and second tools engage a workpiece to produce a finished fastener.

6. The machine tool system of claim 2 further comprising a third tool comprising a cylindrical die which has a reference indentation.

7. The machine tool system of claim 1 wherein said sensor is an eddy current sensor.

8. The machine tool system of claim 1 wherein each said sensor is selected from the group consisting of an optical, electromagnetic, ultrasonic or mechanical sensor.

9. A machine tool system including tools operable for serially cold forming workpieces comprising:

a first rotatable tool comprising a first positioner and a first die which engages a workpiece and has a first reference feature;

a second rotatable tool comprising a second positioner and a second die which engages said workpiece and has a second reference feature;

a first sensor which senses a position of said first reference feature and generates a first matching signal;

a second sensor which senses a position of said second reference feature and generates a second matching signal;

said first and second dies each is a cylindrical die which defines a helical thread form and the reference feature is indentation defined in an end surface of the die and disposed at a pre-established distance from a match point of the helical thread form; and a processor which receives said first and second matching signals, determines changes in the positions of said dies and generates corresponding positioner signals to said first and second positioners and which control positions of said first and second dies to match said dies during set up and while the machine is continuously operating.

10. The machine tool system of claim 9 wherein each said sensor is an eddy current sensor.

11. The machine tool system of claim 9 wherein each said positioner comprises a servo motor and a mechanical linkage which adjusts the position of one of said dies.

12. The machine tool system of claim 9 further comprising a third tool comprising a cylindrical die with a third reference feature.

13. The machine tool system of claim 12 wherein said first, second and third tools engage a workpiece to produce a threaded fastener.

14. A method for matching rotatable dies in a cold forming tooling machine comprising:

loading a plurality of dies in a cold forming tooling machine wherein each die has a reference indentation;

automatically sensing by a corresponding sensor a change of position in a reference indentation on a die while the die is rotating; and employing the change in position to adjust a position of a die to continuously match the plurality of dies during initial setup and while the machine is continuously operating.

15. The method of claim 14 wherein a change in eddy current of each die is employed to sense the change in position of the die.

16. The method of claim 14 further comprising angularly adjusting the position of the die by means of a servo motor.

17. The method of claim 14 further comprising rotating a die past a sensor and establishing a reference for the die height.

18. The method of claim 17 further comprising running an algorithm on a computer to establish height differences among the plurality of dies.

19. The method of claim 18 further comprising rotating the dies over a sensor to find a position of each reference feature.

20. The method of claim 19 further comprising running an algorithm and rotating the dies to a matched position based on data established by the algorithm.

21. A method for matching rotatable cylindrical dies in a cold forming tooling machine for serially forming workpieces during setup without employing a master workpiece comprising:

loading a plurality of dies into said machine, including at least one reference die which has a die form with a match point and an indentation defined in an end portion of the reference die at a pre-established distance relative to the match point, and each of said dies has a positioner which positions said die;

rotating at least one reference die;

automatically sensing each indentation by a corresponding sensor to generate at least one matching signal;

automatically processing at least one matching signal to generate at least one positioning signal to at least one positioner; and automatically positioning at least one die to match said plurality of dies.

* * * * *